US011710896B2

(12) United States Patent
Shin et al.

(10) Patent No.: US 11,710,896 B2
(45) Date of Patent: Jul. 25, 2023

(54) ANTENNA DEVICE AND IMAGE DISPLAY DEVICE INCLUDING THE SAME

(71) Applicant: DONGWOO FINE-CHEM CO., LTD., Jeollabuk-do (KR)

(72) Inventors: Seung Hyun Shin, Seoul (KR); Na Yeon Kim, Seoul (KR); Byung Jin Choi, Incheon (KR)

(73) Assignee: DONGWOO FINE-CHEM CO., LTD., Jeollabuk-Do (KR)

( * ) Notice: Subject to any disclaimer, the term of this patent is extended or adjusted under 35 U.S.C. 154(b) by 16 days.

(21) Appl. No.: 17/574,747

(22) Filed: Jan. 13, 2022

(65) Prior Publication Data

US 2022/0224000 A1 Jul. 14, 2022

(30) Foreign Application Priority Data

Jan. 14, 2021 (KR) ..... 10-2021-0005262

(51) Int. Cl.
*H01Q 1/38* (2006.01)
*H01Q 1/44* (2006.01)
*H01Q 1/48* (2006.01)

(52) U.S. Cl.
CPC ..... *H01Q 1/38* (2013.01); *H01Q 1/44* (2013.01); *H01Q 1/48* (2013.01)

(58) Field of Classification Search
CPC ..... H01Q 1/38; H01Q 1/44; H01Q 1/48
See application file for complete search history.

(56) References Cited

FOREIGN PATENT DOCUMENTS

KR 10-2003-0095557 A 12/2003
KR 1020030095557 * 12/2003 ..... H01Q 1/24

* cited by examiner

*Primary Examiner* — Andrea Lindgren Baltzell
(74) *Attorney, Agent, or Firm* — The PL Law Group, PLLC

(57) ABSTRACT

An antenna device according to an embodiment of the present invention includes a substrate layer, an antenna unit formed on a top surface of the substrate layer, a circuit wiring disposed on the top surface of the substrate layer and directly connected to the antenna unit, a stress compensation layer covering the circuit wiring on the top surface of the substrate layer and having a thickness greater than a thickness of the substrate layer, a first dielectric layer formed on a bottom surface of the substrate layer to overlap the circuit wiring in a planar view, and a first ground layer overlapping the circuit wiring in the planar view with the first dielectric layer or the stress compensation layer interposed therebetween.

19 Claims, 7 Drawing Sheets

ANTENNA DEVICE AND IMAGE DISPLAY DEVICE INCLUDING THE SAME

CROSS-REFERENCE TO RELATED APPLICATION AND CLAIM OF PRIORITY

This application claims priority to Korean Patent Application No. 10-2021-0005262 filed on Jan. 14, 2021 in the Korean Intellectual Property Office (KIPO), the entire disclosures of which are incorporated by reference herein.

BACKGROUND

1. Field

The present invention relates to an antenna device and an image display device including the same. More particularly, the present invention relates to an antenna device including a substrate layer and an antenna unit and an image display device including the same.

2. Description of the Related Art

As information technologies have been developed, a wireless communication technology such as Wi-Fi, Bluetooth, etc., is combined with an image display device in, e.g., a smartphone form. In this case, an antenna may be combined with the image display device to provide a communication function.

As mobile communication technologies have been rapidly developed, an antenna capable of operating a high frequency or ultra-high frequency communication corresponding to 3G to 5G communication is needed in the display device.

However, as a driving frequency of the antenna increases, signal loss may become greater. As a length of a transmission path increases, a degree of signal loss may further increase.

Additionally, an intermediate circuit structure such as a flexible printed circuit board (FPCB) may be used to electrically connect a driving integrated circuit chip and the antenna with each other for an antenna feeding/driving control, and an additional signal loss may be caused by the intermediate circuit structure.

As the image display device becomes thinner and a display area increases, a space for accommodating the antenna may decrease. Further, when the intermediate circuit structure is added, a volume and a thickness of the image display device may be increased.

For example, Korean Published Patent Application No. 2003-0095557 discloses an antenna structure embedded into a portable terminal, but a construction of an antenna capable of preventing signal loss within a limited space and implementing high-frequency or ultra-high frequency driving is needed.

SUMMARY

According to an aspect of the present invention, there is provided an antenna device having improved signaling reliability and structural efficiency.

According to an aspect of the present invention, there is provided an image display device including an antenna device with improved signaling reliability and structural efficiency.

(1) An antenna device, including: a substrate layer; an antenna unit formed on a top surface of the substrate layer; a circuit wiring disposed on the top surface of the substrate layer and directly connected to the antenna unit; a stress compensation layer covering the circuit wiring on the top surface of the substrate layer and having a thickness greater than a thickness of the substrate layer; a first dielectric layer formed on a bottom surface of the substrate layer to overlap the circuit wiring in a planar view; and a first ground layer overlapping the circuit wiring in the planar view with the first dielectric layer or the stress compensation layer interposed therebetween.

(2) The antenna device of the above (1), wherein the first ground layer is disposed on a bottom surface of the first dielectric layer and satisfies Equation 1:

$$80\% \leq (A/B) \times 100 \leq 120\% \quad \text{[Equation 1]}$$

wherein, in Equation 1, A is a thickness of the stress compensation layer, and B is a sum of thicknesses of the substrate layer, the first dielectric layer and the first ground layer.

(3) The antenna device of the above (1), wherein the first ground layer is disposed on a top surface of the stress compensation layer and satisfies Equation 2:

$$80\% \leq (C/D) \times 100 \leq 120\% \quad \text{[Equation 2]}$$

wherein, in Equation 2, C is a sum of thicknesses of the stress compensation layer and the first ground layer, and D is a sum of thicknesses of the substrate layer and the first dielectric layer.

(4) The antenna device of the above (1), further including a second dielectric layer formed on the bottom surface of the substrate layer to overlap the antenna unit in the planar view.

(5) The antenna device of the above (4), wherein the first dielectric layer and the second dielectric layer are located at the same level and have different thicknesses from each other.

(6) The antenna device of the above (4), further including a second ground layer disposed under the second dielectric layer to overlap the antenna unit in the planar view.

(7) The antenna device of the above (1), further including a third dielectric layer covering the antenna unit on the top surface of the substrate layer.

(8) The antenna device of the above (7), wherein the third dielectric layer and the stress compensation layer are located at the same level and have different thicknesses.

(9) The antenna device of the above (1), wherein the antenna unit includes a radiator and a transmission line extending from the radiator.

(10) The antenna device of the above (9), wherein the circuit wiring and the transmission line are an integral single member.

(11) The antenna device of the above (9), wherein the radiator and the transmission line have a mesh structure, and the circuit wiring has a solid structure.

(12) The antenna device of the above (1), wherein the substrate layer has an antenna area in which the antenna unit is disposed and a circuit extension area in which the circuit wiring is disposed, and a portion of the substrate layer of the circuit extension area is bent together with the circuit wiring, the stress compensation layer, the first dielectric layer and the first ground layer.

(13) The antenna device of the above (12), further including an antenna driving integrated circuit (IC) chip electrically connected to a bent terminal end portion of the circuit wiring.

(14) The antenna device of the above (12), further including a printed circuit board disposed between the substrate layer and the antenna driving IC chip to electrically connect the circuit wiring and the antenna driving IC chip to each other.

(15) The antenna device of the above (14), wherein the printed circuit board is a rigid printed circuit board.

(16) An image display device, including: a display panel including a display area and a peripheral area; and the antenna device according to embodiments as described above disposed on the display panel.

(17) The image display device of the above (16), wherein the circuit wiring of the antenna device is bent along a lateral portion of the display panel in the peripheral area together with the substrate layer.

(18) The image display device of the above (17), further including an insulating structure disposed between the display panel and the antenna device, wherein the insulating structure is disposed under a portion of the substrate layer on which the antenna unit is disposed.

(19) The image display device of the above (18), wherein the insulating structure includes a polarizing layer.

According to embodiments of the present invention, a circuit wiring directly connected to an antenna unit may be formed together with the antenna unit on a substrate on which the antenna unit is disposed. Accordingly, an intermediate circuit structure such as a flexible printed circuit board (FPCB) for connecting the antenna driving IC chip and the antenna unit may be omitted, so that a signal loss may be reduced or substantially removed.

In exemplary embodiments, the antenna device may include a stress compensation layer formed on the substrate layer to cover the circuit wiring. Accordingly, a neutral plane of the antenna device may be located within the circuit wiring. Thus, a concentration of a tensile stress in the circuit wiring at a bent portion of the antenna device may be prevented, thereby suppressing disconnection, destruction and/or damage of the circuit wiring, and achieving durability and driving stability of the antenna device.

The antenna device may be applied to a display device including a mobile communication device capable of transmitting and receiving signals in 3G, 4G, 5G or higher high-frequency or ultra-high frequency bands to improve radiation properties and optical properties such as a transmittance.

DETAILED DESCRIPTION OF THE EMBODIMENTS

According to exemplary embodiments of the present invention, there is provided an antenna device that includes an antenna unit and a circuit wiring on a substrate layer, and a stress compensation layer on the circuit wiring layer The antenna device may be, e.g., a microstrip patch antenna fabricated in the form of a transparent film. The antenna device may be applied to communication devices for a mobile communication of a high or ultrahigh frequency band corresponding to a mobile communication of, e.g., 3G, 4G, 5G or more.

According to exemplary embodiments of the present invention, there is also provided a display device including the antenna structure. An application of the antenna structure is not limited to the display device, and the antenna structure may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

The terms "upper", "lower", "top", "bottom", etc., herein are not intended to designate an absolute position, but are used to distinguish a relative position between different elements.

Figure 1:
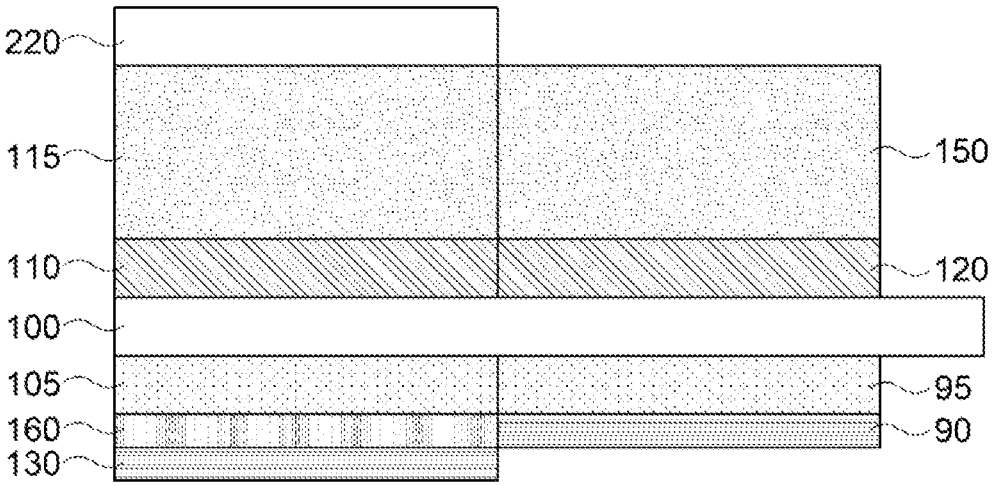
FIGS. 1 and 2 are cross-sectional views illustrating antenna devices in accordance with exemplary embodiments.
Figure 2:
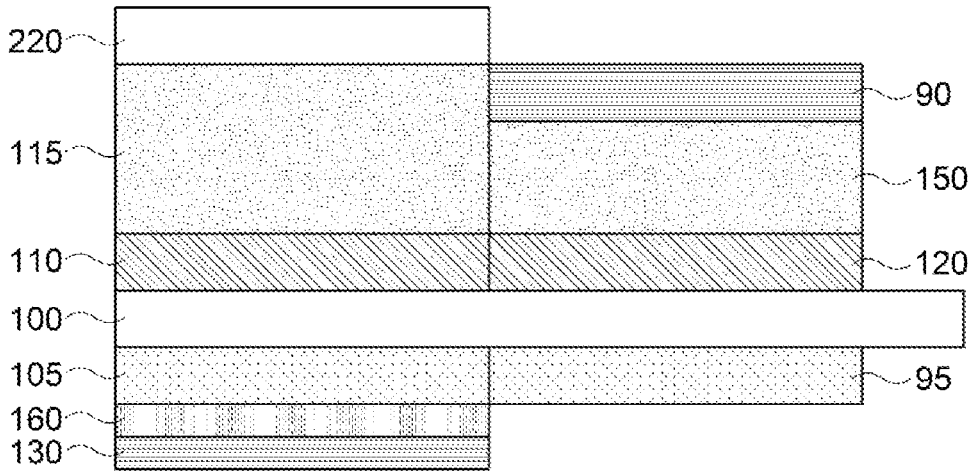

FIGS. 1 and 2 are cross-sectional views illustrating antenna devices in accordance with exemplary embodiments.

Referring to FIGS. 1 and 2, the antenna device may include an antenna unit 110 disposed on a substrate layer 100. A circuit wiring 120 connected to the antenna unit 110 may be disposed on the substrate layer 100 together with the antenna unit 110.

The substrate layer 100 may include a support layer or a film-type substrate for forming the antenna unit 110. For example, the substrate 100 may include glass, a polymer, and/or an inorganic insulating material. Examples of the polymer may include cyclic olefin polymer (COP), polyethylene terephthalate (PET), polyacrylate (PAR), polyetherimide (PEI), polyethylene naphthalate (PEN), polyphenylene sulfide (PPS), polyallylate, polyimide (PI), cellulose acetate propionate (CAP), polyethersulfone (PES), cellulose triacetate (TAC), polycarbonate (PC), cyclic olefin copolymer (COC), polymethyl methacrylate (PMMA), etc. Examples of the inorganic insulating material may include glass, silicon oxide, silicon nitride, silicon oxynitride, a metal oxide, etc.

The substrate layer 100 may serve as a dielectric layer for the antenna unit 110. For example, capacitance or inductance may be generated by the substrate layer 100, so that a frequency band of the antenna device may be adjusted.

In some embodiments, a dielectric constant of the substrate layer 100 may be adjusted in a range from about 1.5 to 12. If the dielectric constant exceeds about 12, a driving frequency may be excessively reduced, so that an antenna driving in a desired high frequency or ultra-high frequency band may not be implemented.

Preferably, the substrate layer 100 may include COP to improve flexible properties.

In exemplary embodiments, a first dielectric layer 95 may be formed on a bottom surface of the substrate layer 100 to overlap the circuit wiring 120 in a planar view. If the antenna device according to exemplary embodiments, an intermediate circuit structure such as a flexible printed circuit board may be omitted. Accordingly, the first dielectric layer 95 may be additionally formed for an impedance matching or a dielectric constant matching corresponding to the intermediate circuit structure.

In exemplary embodiments, the antenna device may further include a second dielectric layer 105 formed on the bottom surface of the substrate layer 100 to overlap the antenna unit 110 in the planar view. Radiation independence and radiation efficiency through the antenna unit 110 may be improved by the second dielectric layer 105 while preventing signal loss and signal interference from electrodes and wirings included in a display panel to which the antenna device is applied.

In some embodiments, the first dielectric layer 95 and the second dielectric layer 105 may be disposed at the same layer or at the same level, and may have different thicknesses.

For example, a thickness of the first dielectric layer 95 may be adjusted in consideration of implementing an impedance/permittivity matching effect corresponding to the omitted intermediate circuit structure. A thickness of the second dielectric layer 105 may be adjusted in consideration of preventing signal loss and improving radiation independence of the antenna unit 110.

Accordingly, the thicknesses of the first dielectric layer 95 and the second dielectric layer 105 may be different from each other in one antenna device, and the antenna device capable of achieving improved impedance/permittivity matching and having reduced signal loss may be obtained.

The above-described first dielectric layer 95 and/or second dielectric layer 105 may include a transparent resin material having flexibility to be folded. For example, the first dielectric layer 95 and/or second dielectric layer 105 may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth)acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyethersulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; an epoxy-based resin; a urethane or acrylic urethane-based resin; a silicone-based resin, etc. These may be used alone or in a combination thereof.

In some embodiments, the first dielectric layer 95 and/or second dielectric layer 105 may include an adhesive material such as an optically clear adhesive (OCA), an optically clear resin (OCR), or the like. In some embodiments, the first dielectric layer 95 and/or second dielectric layer 105 may include an inorganic insulating material such as glass, silicon oxide, silicon nitride, silicon oxynitride, etc.

In some embodiments, a dielectric constant of the first dielectric layer 95 and/or second dielectric layer 105 may be adjusted in a range from about 1.5 to about 12. When the dielectric constant exceeds about 12, a driving frequency may be excessively decreased, so that driving in a desired high frequency or ultra-high frequency band may not be implemented.

In exemplary embodiments, the antenna device may further include an optical layer 160 on a bottom surface of the second dielectric layer 105. The optical layer 160 may include, e.g., a polarizer or a polarizing plate.

As illustrated in FIGS. 1 and 2, the antenna device may further include a first ground layer 90 overlapping the circuit wiring 120 in a planar view with the first dielectric layer 95 or a stress compensation layer 150 interposed therebetween.

The first ground layer 90 may overlap or face the circuit wiring 120 in a thickness direction. Noise and signal interference around the circuit wiring 120 may be absorbed or shielded by the first ground layer 90, and signal transmission efficiency may be improved by a generation an electric field between the first ground layer 90 and the circuit wiring 120.

For example, the first ground layer 90 may be disposed at only one level above or below the circuit wiring 120.

When the first ground layer 90 is formed above and below the circuit wiring 120, the first ground layer 90 disposed above and below the circuit wiring 120 functions as a capacitor. As a result, signal transmission efficiency of the circuit wiring 120 may be reduced, and the function of the circuit wiring 120 may not be substantially implemented.

In exemplary embodiments, a second ground layer 130 may be disposed under the second dielectric layer 105 to overlap the antenna unit 110 in the planar view.

The second ground layer 130 may be disposed in consideration of a resonance frequency of the antenna device, and a substantially vertical radiating antenna may be implemented through a generation of an electric field or inductance between the antenna unit 110 and the second ground layer 130.

In some embodiments, the first ground layer 90 and the second ground layer 130 may be separated at different layers or different levels and may have different thicknesses. Accordingly, the first ground layer 90 and the second ground layer 130 having different thicknesses may be included in one antenna element according to the function of each ground layer.

For example, the thickness of the first ground layer 90 may be adjusted in consideration of signal transmission efficiency of the circuit wiring 120. The thickness of the second ground layer 130 may be adjusted in consideration of enhancement of vertical radiation property. Accordingly, the antenna device implementing improved signal transmission and vertical radiation may be achieved.

The above-described circuit wiring 120, the first ground layer 90 and the second ground layer 130 may include a metal and/or an alloy to be described later.

Figure 3:
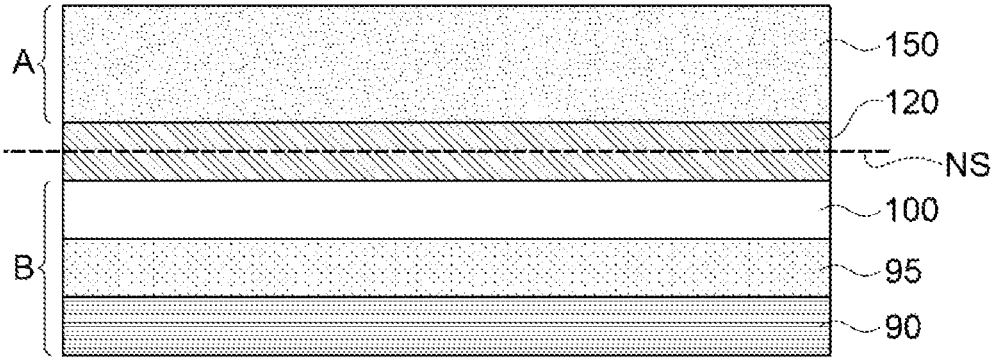
FIG. 3 is a schematic cross-sectional view illustrating a stacked structure of an antenna device in accordance with some exemplary embodiments.

FIG. 3 is a schematic cross-sectional view illustrating a stacked structure of an antenna device in accordance with some exemplary embodiments.

Referring to FIG. 3, a neutral surface (NS) with respect to the total thickness of the antenna element may be formed.

A tensile stress and a compressive stress may be applied at a bent portion of the antenna device. If a neutral plane NS is present in the circuit wiring 120, the tensile stress and the compressive stress applied to the circuit wiring 120 at the bent portion of the antenna device may offset each other so that, disconnection, destruction and/or damage of the circuit wiring 120 may be suppressed.

As the neutral plane NS is farther from the circuit wiring 120, the tensile stress applied to the circuit wiring 120 may be increased, which may cause disconnection, destruction and/or damage to the circuit wiring 120.

For example, when the neutral plane of the bent portion of the antenna device is located on the bottom surface of the circuit wiring 120, the tensile stress applied on the circuit wiring 120 becomes greater than the compressive stress. As a result, durability and driving stability of the antenna device may be degraded.

However, according to exemplary embodiments, the antenna device may include the stress compensation layer 150 formed on the substrate layer 100 to cover the circuit wiring 120. The stress compensation layer 150 may be selectively formed on the bent portion of the antenna device so that the neutral plane NS of the antenna device may be located in the circuit wiring 120. Thicknesses of the compensation layer 150, the first dielectric layer 95 and/or the first ground layer 90 may be adjusted from the above-described aspect.

In exemplary embodiments, a thickness of the stress compensation layer 150 may be greater than a thickness of the substrate layer 100. Accordingly, the neutral plane NS of the antenna device may be moved in a direction from an outer surface of the antenna device to a center of the antenna device, and a stress concentration to the circuit wiring 120 may be prevented.

In some embodiments, the first ground layer 90 may be disposed on a bottom surface of the first dielectric layer 95, and Equation 1 below may be satisfied.

$$80\% \leq (A/B) \times 100 \leq 120\% \quad \text{[Equation 1]}$$

In Equation 1, A is the thickness of the stress compensation layer 150 and B is a sum of the thicknesses of the substrate layer 100, the first dielectric layer 95 and the first ground layer 90.

In some embodiments, the first ground layer 90 may be disposed on a top surface of the stress compensation layer 150 and Equation 2 below may be satisfied.

$$80\% \leq (C/D) \times 100 \leq 120\% \quad \text{[Equation 2]}$$

In Equation 2, C is a sum of the thicknesses of the stress compensation layer 150 and the first ground layer 90, and D is a sum of the thicknesses of the substrate layer 100 and the first dielectric layer 95.

In the relations represented by Equation 1 or Equation 2 is satisfied, the neutral plane NS of the antenna device may be formed in the circuit wiring 120. Accordingly, the tensile stress applied to the circuit wiring 120 may be reduced and disconnection and/or damage of the circuit wiring 120 may be reduced, so that durability and driving stability of the antenna device may be improved.

In exemplary embodiments, the stress compensation layer 150 may include an adhesive film, a transparent resin material, an inorganic insulating material, glass and/or a polymer substantially the same as those mentioned in the substrate layer 100, the first dielectric layer 95 and/or the second dielectric layer 105.

In some embodiments, the antenna device may further include a third dielectric layer 115 covering the antenna unit 110 on a top surface of the substrate layer 100. The reduction of signal loss and enhancement of radiation efficiency of the antenna unit 110 may be further facilitated by the third dielectric layer 115.

The third dielectric layer 115 may include an adhesive film, a transparent resin material and/or an inorganic insulating material substantially the same as those of the first dielectric layer 95 and the second dielectric layer 105.

In some embodiments, the third dielectric layer 115 and the stress compensation layer 150 may be disposed at the same layer or at the same level, and may have different thicknesses. Accordingly, in consideration of an operation of each layer, the third dielectric layer 115 and the stress compensation layer 150 may be provided as separate layers having different thicknesses in one antenna device.

For example, the thickness of the third dielectric layer 115 may be adjusted in consideration of preventing signal loss and improving radiation independence of the antenna unit 110. The thickness of the stress compensation layer 150 may be adjusted in consideration of a reduction in tensile stress applied to the circuit wiring 120. Accordingly, it is possible to design an antenna element in which signal loss is prevented and tensile stress applied to the circuit wiring 120 is reduced.

For example, the thickness of the third dielectric layer 115 may be adjusted in consideration of preventing signal loss and improving radiation independence of the antenna unit 110. The thickness of the stress compensation layer 150 may be adjusted in consideration of reduction of the tensile stress applied to the circuit wiring 120. Accordingly, the antenna device having reduced signal loss and tensile stress applied to the circuit wiring 120 may be achieved.

Figure 4:
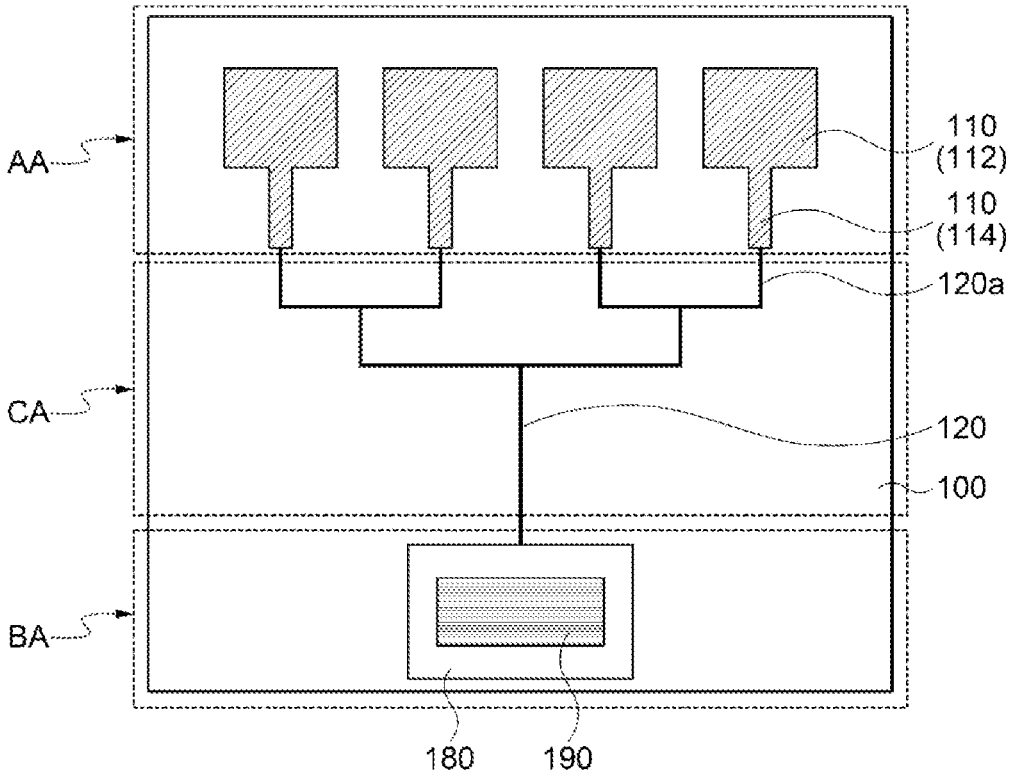
FIGS. 4 to 6 are schematic top planar views illustrating antenna devices in accordance with exemplary embodiments.
Figure 5:
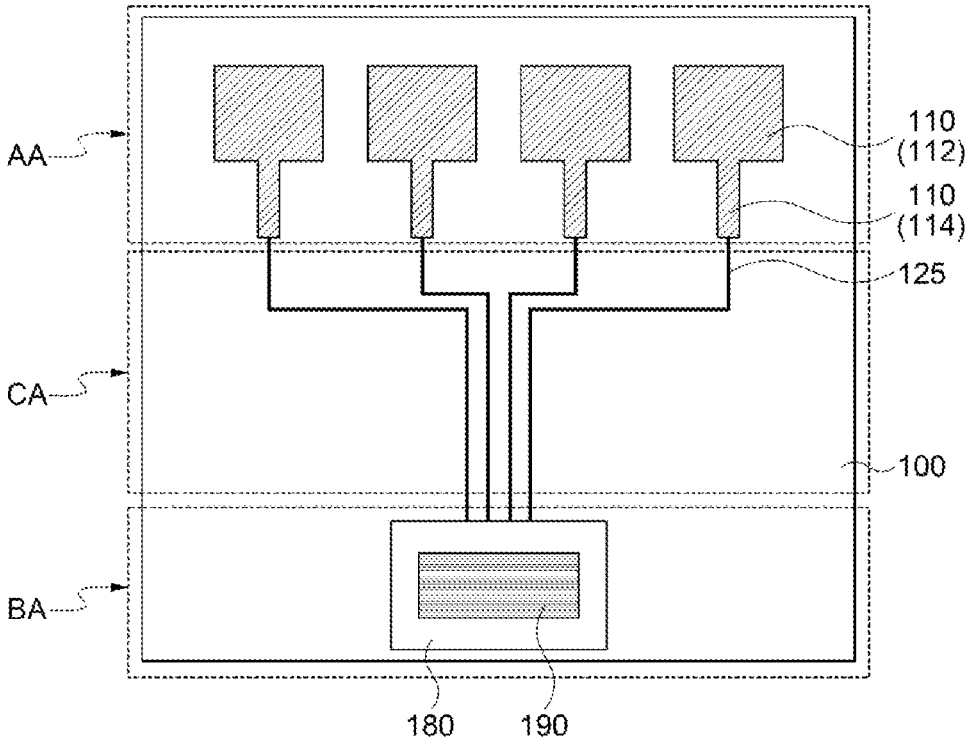
Figure 6:
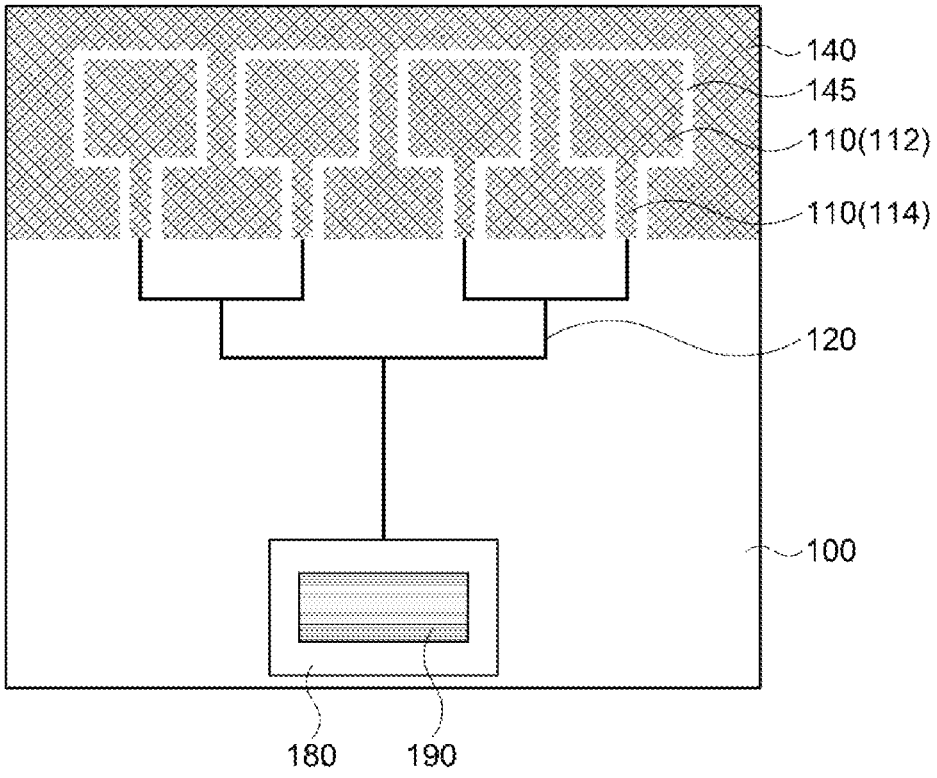

FIGS. 4 to 6 are schematic top planar views illustrating antenna devices in accordance with exemplary embodiments.

Referring to FIG. 4, in exemplary embodiments, the substrate layer 100 may include an antenna area AA, a circuit extension area CA and a bonding area BA. Accordingly, the antenna device may also be divided into the antenna area AA, the circuit extension area CA and the bonding area BA.

The antenna unit 110 may be disposed on the top surface of the substrate layer 100 in, e.g., the antenna area AA. The antenna unit 110 may include a radiator 112 and a transmission line 114.

The radiator 112 may have a polygonal plate shape, and the transmission line 114 may have a line shape extending from one side of the radiator 112. In some embodiments, the radiator 112 and the transmission line 114 may be a single member substantially integral with each other. The transmission line 114 may have a smaller width than that of the radiator 112.

The antenna unit 110 may include silver (Ag), gold (Au), copper (Cu), aluminum (Al), platinum (Pt), palladium (Pd), chromium (Cr), titanium (Ti), tungsten (W), and niobium. (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy containing at least one of the metals. These may be used alone or in combination of two or more therefrom.

In an embodiment, the antenna unit 110 may include silver (Ag) or a silver alloy (e.g., silver-palladium-copper (APC)), or copper (Cu) or a copper alloy (e.g., a copper-calcium (CuCa)) to implement a low resistance and a fine line width pattern.

In some embodiments, the antenna unit 110 may include a transparent conductive oxide such indium tin oxide (ITO), indium zinc oxide (IZO), zinc oxide (ZnOx), indium zinc tin oxide (IZTO), etc.

In some embodiments, the antenna unit 110 may include a stacked structure of a transparent conductive oxide layer and a metal layer. For example, the antenna unit 110 may include a double-layered structure of a transparent conductive oxide layer-metal layer, or a triple-layered structure of a transparent conductive oxide layer-metal layer-transparent conductive oxide layer. In this case, flexible property may be improved by the metal layer, and a signal transmission speed may also be improved by a low resistance of the metal layer. Corrosive resistance and transparency may be improved by the transparent conductive oxide layer.

The antenna unit 110 may include a blackened portion, so that a reflectance at a surface of the antenna unit 110 may be decreased to suppress a visual recognition of the antenna unit due to a light reflectance.

In an embodiment, a surface of the metal layer included in the antenna unit 110 may be converted into a metal oxide or a metal sulfide to form a blackened layer. In an embodiment, a blackened layer such as a black material coating layer or a plating layer may be formed on the antenna unit 110 or the metal layer. The black material or plating layer may include silicon, carbon, copper, molybdenum, tin, chromium, molybdenum, nickel, cobalt, or an oxide, sulfide or alloy containing at least one therefrom.

A composition and a thickness of the blackened layer may be adjusted in consideration of a reflectance reduction effect and an antenna radiation property.

In exemplary embodiments, the circuit wiring 120 may be formed on the substrate layer 100 together with the antenna unit 110, and may be directly connected to the antenna unit 110. The antenna unit and the circuit wiring may be located together at the same layer or at the same level.

For example, one end portion of the circuit wiring 120 may be directly connected to the transmission line 114 of the antenna unit 110. The circuit wiring 120 may extend on the top surface of the substrate layer 100 in the circuit extension area CA, and the other end portion of the circuit wiring 120 may extend to the bonding area BA.

In some embodiments, a portion of the substrate layer 100 of the circuit extension area CA may be bent together with the circuit wiring 120, the stress compensation layer 150, the first dielectric layer 95 and the first ground layer 90. Accordingly, the other end portion of the circuit wiring 120 may extend to be connected to an antenna driving IC chip without an additional intermediate circuit board.

In some embodiments, the circuit wiring 120 may include a merge wiring 120*a*. For example, a plurality of the antenna units 110 may be arranged in an array form on the antenna area AA, and the predetermined number of the antenna units 110 may be coupled by the merge wiring 120*a*.

For example, as illustrated in FIG. 4, two antenna units 110 or four antenna units 110 may be coupled by the merge wiring 120*a*.

The other end portion of the circuit wiring 120 may be electrically connected to the antenna driving integrated circuit (IC) chip 190 on the bonding area BA. Accordingly, a feeding and a driving signal may be directly received from the antenna driving IC chip 190.

For example, the other end portion of the circuit wiring 120 and an IC pad or an IC pin in the antenna driving IC chip 190 may be electrically connected to each other through a circuit included in a printed circuit board 180.

The printed circuit board 180 may include a core layer, and the circuit may be distributed at an inside and/or on a surface of the core layer. In exemplary embodiments, the core layer may include a material having a strength and a glass transition temperature higher than those of the substrate layer 100. For example, the core layer may include a resin impregnated with an inorganic material such as glass fiber (e.g., a prepreg).

In an embodiment, the printed circuit board 180 may be a rigid PCB. Accordingly, sufficient thermal and mechanical stability may be maintained even when the antenna driving IC chip 190 may be stacked on the printed circuit board 180 through, e.g., a surface mount technology (SMT).

In some embodiments, the antenna driving IC chip 190 may be directly mounted on the substrate layer 100. In this case, the printed circuit board 180 may be omitted.

According to the above-described exemplary embodiments, the antenna units 110 and the circuit wiring 120 may be formed together on the substrate layer 100. Thus, a separate intermediate circuit structure such as a flexible printed circuit board (FPCB) for connecting the antenna driving IC chip 190 and the antenna unit 110 may be omitted.

Therefore, signal/feeding loss and signal resistance increase caused by an addition of the flexible printed circuit board may be prevented to improve feeding/radiation efficiency. Additionally, the circuit wiring 120 may be directly connected to the transmission line 114 of the antenna unit 110, so that misalignment that may occur in a bonding process of the flexible printed circuit board may also be avoided.

Further, an intermediate conductive structure such as a signal pad, a ground pad or an anisotropic conductive film (ACF) for connecting the transmission line 114 of the antenna unit 110 and the flexible printed circuit board (FPCB) to each other may be omitted. Accordingly, the circuit wiring 120 and the transmission line 114 may be substantially directly connected to each other.

Accordingly, a length of the signal path between the antenna driving IC chip 190 and the radiator 112 may be further decreased, thereby effectively reducing signal loss occurring in a high-frequency or ultrahigh-frequency communication.

In some embodiments, the transmission line 114 and the circuit wiring 120 may be a substantially single member to be provided as an integral line.

In some embodiments, the transmission line 114 and the circuit wiring 120 may have different widths or thicknesses, and may include different materials. For example, the transmission line 114 may be designed to have a size for an impedance matching according to a resonance frequency implemented from the radiator 112.

Referring to FIG. 5, a circuit wiring 125 may be individually and independently connected to each antenna unit 110. Accordingly, feeding/driving control may be independently performed for each of a plurality of the antenna units 110.

For example, signals of different phase may be applied to the antenna units 110 through circuit wirings 125, each of which is independently connected to the plurality of antenna units 110.

Referring to FIG. 6, the radiator 112 and the transmission line 114 of the antenna unit 110 may include a mesh structure. In this case, a dummy mesh pattern 140 may be formed around the radiator 112 and the transmission line 114.

In some embodiments, the dummy mesh pattern 140 and the antenna unit 110 may include the same mesh structure (e.g., having the same line width and the same pitch). For example, the dummy mesh pattern 140 and the antenna unit 110 may be formed from the same conductive layer, and may be separated and defined from each other by a separation region 145 formed together while forming a mesh structure from the conductive layer by an etching process.

The radiator 112 and the transmission line 114 may be disposed in a display area of the image display device as will be described later. In this case, the radiator 112 and the transmission line 114 may include the mesh structure, so that transmittance on the display area may be improved. Additionally, a structure of an electrode pattern around the antenna unit 110 may become uniform by the dummy mesh pattern 140, so that electrodes of the antenna device may be prevented from being visually recognized by a user.

In some embodiments, the circuit wiring 120 may be formed of a solid metal pattern or a solid metal line to reduce a feeding resistance and prevent a signal loss.

Figure 7:
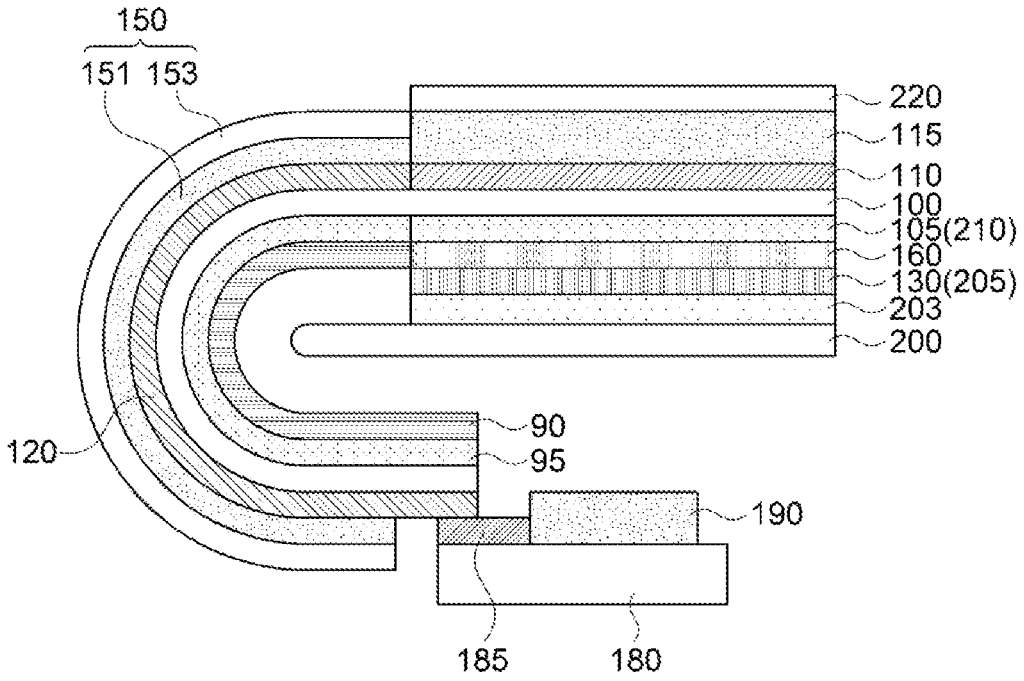
FIG. 7 is a schematic cross-sectional view illustrating a coupled structure of an antenna device and an image display device in accordance with some exemplary embodiments.

FIG. 7 is a schematic cross-sectional view illustrating a coupled structure of an antenna device and an image display device in accordance with some exemplary embodiments.

Referring to FIG. 7, the image display device may include a display layer 203 stacked on a display panel 200. The display layer 203 may include, e.g., an organic light emitting layer or a liquid crystal display layer. The display panel 200 may include a panel substrate and a thin film transistor (TFT) array disposed on the panel substrate.

A common electrode 205 of the image display device may be disposed on the display layer 203. For example, the common electrode 205 may serve as a cathode of the image display device, and may extend commonly and continuously on a plurality of pixels defined by the TFT array.

The panel substrate may include, e.g., a flexible resin such as polyimide, and the image display device may serve as a flexible or foldable display device.

The antenna unit 110 of the antenna device according to the above-described exemplary embodiments may be formed on the substrate layer 100 and stacked on an insulating structure 210 of the image display device. For example, the insulating structure 210 may include an adhesive layer or an encapsulation layer of the display panel 200.

In some embodiments, the insulating structure 210 may include a polarization layer.

In some embodiments, the insulating structure 210 may serve as the second dielectric layer 105 of the antenna device.

In some embodiments, a cover window 220 may be stacked on the antenna unit 110. The cover window 220 may include, e.g., glass (e.g., ultra-thin glass (UTG)) or a transparent resin film.

The circuit wiring 120 of the antenna device may be bent along a lateral portion of the display panel 200 together with the circuit extension area CA of the substrate layer 100.

As illustrated in FIG. 7, the lateral portion of the display panel 200 may have a curved surface, and the bent portion of the antenna device may also be curved along the curved surface. Alternatively, the lateral portion of the display panel 200 may have a vertical surface, and the bent portion of the antenna device may also have a bent profile along the vertical surface.

In some embodiments, the printed circuit board 180 and the antenna driving IC chip 190 may be disposed under the display panel 200. A terminal end portion of the circuit wiring 120 of the antenna device may be bent below the display panel 200 together with a portion of the substrate layer 100 in the bonding area BA to be electrically connected to the printed circuit board 180 and the antenna driving IC chip 190.

For example, the antenna driving IC chip 190 and the circuit wiring 120 of the antenna device may be electrically connected through a connection wiring 185 disposed on the printed circuit board 180 to perform the feeding and driving control.

In exemplary embodiments, an electrode included in the image display device or the display panel 200 may serve as the second ground layer 130 of the antenna unit 110 or the radiator 112. For example, the common electrode 205 may serve as the second ground layer 130 of the antenna unit 110 or the radiator 112.

Accordingly, a separate antenna ground may be excluded in the display area of the image display device so that degradation of ab image quality due to an insertion of the antenna device may be prevented. Additionally, as described above, the first ground layer 90 may overlap the circuit wiring 120 of the antenna device in a non-display area (e.g., a light-shielding portion or a bezel portion) to absorb/shield a feeding/signal transmission noise.

Further, permittivity/impedance matching with the insulating structure 210 or the second dielectric layer 105 disposed under the radiator 112 may be implemented on the display area using the first dielectric layer 95.

The stacked structure on the display panel 205 or the display layer 203 illustrated in FIG. 7 is an exemplary and non-limiting implementation. For example, a touch sensor or a touch panel may be stacked on the insulating structure 210. The stacking order of the touch panel, the antenna device and the cover window 220 may be properly adjusted in consideration of touch sensing sensitivity, radiation efficiency, prevention of an electrode visual recognition, etc.

In some embodiments, the compensation layer 150 may include an adhesive layer 151 and a protective layer 153.

For example, the adhesive layer 151 may include substantially the same adhesive film as that of the first to third dielectric layers 95, 105 and 115.

For example, the protective layer 153 may include glass, a polymer and/or an inorganic insulating material substantially the same as or similar to that of the substrate layer 100.

In some embodiments, a dielectric constant of the compensation layer 150 including the adhesive layer 151 and the passivation layer 153 may be adjusted in a range from about 1 to 6. Within the range of the dielectric constant of the compensation layer 150, a signal loss of the circuit wiring 120 may be alleviated or reduced to improve an antenna gain. For example, if the dielectric constant exceeds about 6, a driving frequency may be excessively reduced, and driving in a desired high frequency or ultrahigh frequency band may not be implemented.

Figure 8:
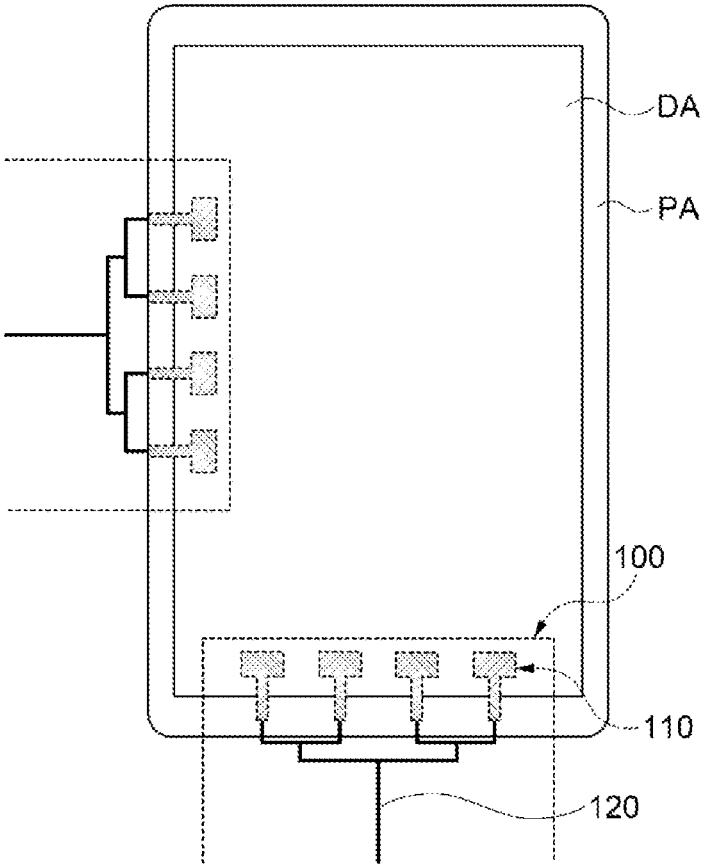
FIG. 8 is a schematic top planar view illustrating an image display device in accordance with exemplary embodiments.

FIG. 8 is a schematic top planar view illustrating an image display device in accordance with exemplary embodiments. The substrate layer 100, the antenna unit 110 and the circuit wiring 120 of FIG. 8 are enlarged compared to actual size thereof for convenience of explanation.

Referring to FIG. 8, the image display device may be fabricated in the form of, e.g., a smart phone, and FIG. 8 shows a front portion or a window surface of the image display device. The front portion of the image display device may include a display area DA and a peripheral area PA. The peripheral area PA may correspond to, e.g., a light-shielding portion or a bezel portion of the image display device.

The antenna unit 110 included in the aforementioned antenna device may be at least partially disposed on the display area DA. In this case, the radiator 112 may include a mesh structure, and degradation of transmittance and image quality due to the radiator 112 may be prevented.

In some embodiments, the circuit wiring 120 of the antenna device may be disposed in the peripheral area PA. For example, the circuit wiring 120 may be bent together with the substrate layer 100, and may be bent along the lateral portion of the image display device to be electrically connected to the antenna driving IC chip 180 disposed at a rear portion of the image display device.

In some embodiments, a portion of the transmission line 114 may also be disposed in the peripheral area PA together with the circuit wiring 120.

Hereinafter, preferred embodiments are proposed to more concretely describe the present invention. However, the following examples are only given for illustrating the present invention and those skilled in the related art will obviously understand that various alterations and modifications are possible within the scope and spirit of the present invention. Such alterations and modifications are duly included in the appended claims.

Preparation Example: Fabrication of Stacked Structures in a Circuit Extension Area (CA) of an Antenna Device Stacked structures in a circuit extension area of an antenna device were fabricated to have thicknesses as shown in Tables 1 and 2 below.

TABLE 1

| | Example 1 | Example 2 | Example 3 | Comparative Example 1 | Comparative Example 2 |
|---|---|---|---|---|---|
| (upper) first ground layer (Cu/Ca alloy, μm) | — | — | 22 | — | — |
| stress compensation layer (OCA, μm) protective layer (PET, μm) | 112 | 100 | 30 | 35 | 90 |
| stress compensation layer (OCA, μm) adhesive layer (OCA, μm) | | | 50 | 50 | 50 |
| substrate layer (COP, μm) | 40 | 40 | 40 | 40 | 40 |
| first dielectric layer (OCA, μm) | 50 | 50 | 50 | 50 | 50 |
| (lower) first ground layer (Cu/Ca alloy, μm) | 22 | 22 | — | 22 | 22 |
| thickness ratio based on Equation 1 or 2 (%) | 100 | 89.3 | 113.3 | 75.9 | 125 |

TABLE 2

| | Comparative Example 3 | Comparative Example 4 | Comparative Example 5 | Comparative Example 6 | Comparative Example 7 |
|---|---|---|---|---|---|
| (upper) first ground layer (Cu/Ca alloy, μm) | — | — | — | — | — |
| stress compensation layer (OCA, μm) protective layer (PET, μm) | 30 | 50 | 100 | 150 | — |
| stress compensation layer (OCA, μm) adhesive layer (OCA, μm) | | | | | |
| substrate layer (COP, μm) | 40 | 40 | 40 | 40 | 40 |
| first dielectric layer (OCA, μm) | 50 | 50 | 100 | 100 | 50 |
| (lower) first ground layer (Cu/Ca alloy, μm) | 22 | 22 | 22 | 22 | 22 |
| thickness ratio based on Equation 1 or 2 (%) | 26.8 | 44.6 | 61.7 | 70.8 | 0 |

Experimental Example: Measurement of Stress at a Bent Portion in a Circuit Wiring The stacked structures fabricated according to Examples and Comparative Examples as shown in Tables 1 and 2 were bent by a bending radius of 0.3R to measure a stress generated at a bent portion. Specifically, a bending analysis with 0.3R was performed using SIMULIA ABAQUS software (Dassault Systems). The results are shown in Table 3 below.

TABLE 3

| | Stress (MPa) |
|---|---|
| Example 1 | 306.2 |
| Example 2 | 331.3 |

TABLE 3-continued

| | Stress (MPa) |
|---|---|
| Example 3 | 252.1 |
| Comparative Example 1 | 471.4 |
| Comparative Example 2 | 468.2 |
| Comparative Example 3 | 473.2 |

TABLE 3-continued

| | Stress (MPa) |
|---|---|
| Comparative Example 4 | 485.2 |
| Comparative Example 5 | 484.3 |
| Comparative Example 6 | 485.3 |
| Comparative Example 7 | 478.5 |

Referring to Table 3, in Examples where the compensation layer 150 was stacked and the thickness ratios according to Equation 1 or 2 were within a predetermined range, a tensile stress applied to the circuit wiring 120 was reduced compared to those from Comparative Examples having the thickness ratios that were not within the range, so that stability of the circuit wiring 120 and driving reliability were enhanced.

What is claimed is:

1. An antenna device, comprising:

a substrate layer;

an antenna unit formed on a top surface of the substrate layer;

a circuit wiring disposed on the top surface of the substrate layer and directly connected to the antenna unit;

a stress compensation layer covering the circuit wiring on the top surface of the substrate layer and having a thickness greater than a thickness of the substrate layer;

a first dielectric layer formed on a bottom surface of the substrate layer to overlap the circuit wiring in a planar view; and a first ground layer overlapping the circuit wiring in the planar view with the first dielectric layer or the stress compensation layer interposed therebetween.

2. The antenna device of claim 1, wherein the first ground layer is disposed on a bottom surface of the first dielectric layer and satisfies Equation 1:

$$80\% \leq (A/B) \times 100 \leq 120\% \quad \text{[Equation 1]}$$

wherein, in Equation 1, A is a thickness of the stress compensation layer, and B is a sum of thicknesses of the substrate layer, the first dielectric layer and the first ground layer.

3. The antenna device of claim 1, wherein the first ground layer is disposed on a top surface of the stress compensation layer and satisfies Equation 2:

$$80\% \leq (C/D) \times 100 \leq 120\% \quad \text{[Equation 2]}$$

wherein, in Equation 2, C is a sum of thicknesses of the stress compensation layer and the first ground layer, and D is a sum of thicknesses of the substrate layer and the first dielectric layer.

4. The antenna device of claim 1, further comprising a second dielectric layer formed on the bottom surface of the substrate layer to overlap the antenna unit in the planar view.

5. The antenna device of claim 4, wherein the first dielectric layer and the second dielectric layer are located at the same level and have different thicknesses from each other.

6. The antenna device of claim 4, further comprising a second ground layer disposed under the second dielectric layer to overlap the antenna unit in the planar view.

7. The antenna device of claim 1, further comprising a third dielectric layer covering the antenna unit on the top surface of the substrate layer.

8. The antenna device of claim 7, wherein the third dielectric layer and the stress compensation layer are located at the same level and have different thicknesses.

9. The antenna device of claim 1, wherein the antenna unit includes a radiator and a transmission line extending from the radiator.

10. The antenna device of claim 9, wherein the circuit wiring and the transmission line are an integral single member.

11. The antenna device of claim 9, wherein the radiator and the transmission line have a mesh structure, and the circuit wiring has a solid structure.

12. The antenna device of claim 1, wherein the substrate layer has an antenna area in which the antenna unit is disposed and a circuit extension area in which the circuit wiring is disposed, and a portion of the substrate layer of the circuit extension area is bent together with the circuit wiring, the stress compensation layer, the first dielectric layer and the first ground layer.

13. The antenna device of claim 12, further comprising an antenna driving integrated circuit (IC) chip electrically connected to a bent terminal end portion of the circuit wiring.

14. The antenna device of claim 12, further comprising a printed circuit board disposed between the substrate layer and the antenna driving IC chip to electrically connect the circuit wiring and the antenna driving IC chip to each other.

15. The antenna device of claim 14, wherein the printed circuit board is a rigid printed circuit board.

16. An image display device, comprising:

a display panel including a display area and a peripheral area; and the antenna device of claim 1 disposed on the display panel.

17. The image display device of claim 16, wherein the circuit wiring of the antenna device is bent along a lateral portion of the display panel in the peripheral area together with the substrate layer.

18. The image display device of claim 17, further comprising an insulating structure disposed between the display panel and the antenna device, wherein the insulating structure is disposed under a portion of the substrate layer on which the antenna unit is disposed.

19. The image display device of claim 18, wherein the insulating structure includes a polarizing layer.

* * * * *